United States Patent [19]

Kronseder

[11] Patent Number: 4,802,440

[45] Date of Patent: Feb. 7, 1989

[54] GLUE APPLICATOR FOR LABELING MACHINES

[76] Inventor: Hermann Kronseder, Regensburger Str. 42, D-8404 Worth/Donau, Fed. Rep. of Germany

[21] Appl. No.: 72,903

[22] Filed: Jul. 14, 1987

[30] Foreign Application Priority Data

Jul. 16, 1986 [DE] Fed. Rep. of Germany ..... 8618988

[51] Int. Cl.[4] ..... B05C 1/02

[52] U.S. Cl. ..... 118/261; 118/126

[58] Field of Search ..... 118/261, 126, 413; 15/236 R, 256.51

[56] References Cited

U.S. PATENT DOCUMENTS

| | | | |
|---|---|---|---|
| 2,754,796 | 7/1956 | Faulkner, Jr. et al. | 118/261 X |
| 3,465,456 | 9/1969 | Meyer | 15/236 R |
| 4,315,478 | 2/1982 | Carter | 118/261 X |
| 4,574,417 | 3/1986 | Magnasco | 15/236 R |

FOREIGN PATENT DOCUMENTS

| | | |
|---|---|---|
| 1111562 | of 1961 | Fed. Rep. of Germany . |
| 1586370 | of 1967 | Fed. Rep. of Germany . |
| 7435172 | of 1974 | Fed. Rep. of Germany . |

*Primary Examiner*—John McIntosh

*Attorney, Agent, or Firm*—Fuller, Puerner & Hohenfeldt

[57] ABSTRACT

A glue applicator for a labeling machine has the customary glue roller rotating about a vertical axis. A scraper blade is held adjacent the periphery of the roller to remove excess glue from the roller so that a label to which glue is transferred from the roller will not receive a coating of more than desirable thickness. Relatively small blade inserts provide the sharpened edges for scraping the excess glue from the roller. A support member is mounted to a carrier that swings about an axis parallel to the axis of the roller. The blade insert is clamped against the support member by means of a clamping member whose clamping force is developed by bolts that pass through the clamping member and are threaded into the support member. Eccentric elements are provided for adjusting the support member and, hence, the blade insert carried thereon to achieve a uniform and accurate gap between the scraping edge of the blade insert and the periphery of the roller. Blade inserts can be exchanged quickly by simply loosening the clamping bolts, sliding the insert out, sliding a substitute insert in and retightening the clamping bolts. In some embodiments, it is only necessary to reverse the insert to present a fresh scraper edge toward the roller.

12 Claims, 3 Drawing Sheets

GLUE APPLICATOR FOR LABELING MACHINES

BACKGROUND OF THE INVENTION

The invention disclosed herein relates to machines for applying labels to containers such as bottles. In particular, the invention pertains to devices for controlling the thickness of the film of glue on a glue roller which the labels contact to receive a coat of glue.

There are a variety of devices for applying glue to labels in preparation for applying the labels to bottles. A widely used type of device for applying the glue is described in U.S. Pat. No. 4,512,842. In the typical device, there is a turret rotating about a vertical axis. A series of curved glue pallets are arranged in a circle about the periphery of the turret. These segmental pallets oscillate about vertical axes. At one place in their orbit they contact a roller on whose periphery there is a film of glue. Upon further rotation, the pallets encounter a stack of labels in a magazine. The pallets press against the foremost level and rock so that a level is laid on the surface of the pallet. Upon further rotation, the pallet encounters the periphery of a transfer roller which picks off the labels from the pallet successively and applies the labels to bottles that are being conveyed through the labeling machine. In some cases, one label is applied to the cylindrical body of the bottle and another label is applied to the tapered neck portion of the bottle. Usually there is a doctor blade or the like in close proximity to the surface of the glue coated roller for scraping off all glue except for a thin film on the roller. It is necessary for the doctor blade edge to be perfectly parallel to the surface of the glue roller and it is necessary to provide for adjusting the glue scraping blade through a proper angle relative to the roller and with proper clearance to establish the desired film thickness.

In one known type of glue applicator device the scraper or doctor blade cooperating with the glue coated roller is adjustably arranged on a carrier by means of clamping screws and set screws. The carrier is mounted to a shaft and is rotatable about an axis which is parallel to the rotational axis of the glue roller and has an angular position which is adjustable by means of another adjusting screw as in DE-OS No. 15 86 370. The clamping and adjusting screws mentioned above permit the angular positioning of the scraper blade as well as the projection of the working edge of the blade over the side of the carrier. The adjusting screws acting on the carrier allow rapid and simple adjustment of the scraper blade to obtain the appropriate film thickness. At the basic set point, the working edge of the glue scraper or doctor blade is exactly parallel to the peripheral surface of the glue roller. In any case, glue film thickness on a roller must be precisely controlled. If the film is too thin, the labels will have a coat that is too thin and they may not stick to the bottles or other containers to which the labels are applied in the labeling machine. If the glue film on the roller is too thick, the film on the labels picked up from the label storage magazine will be too thick in which case the labels have a tendency to float or drift along the surface of the bottle to which they are applied. In another type of glue applicator device the glue scraper is arranged so as to be radially displaceable on a stationary carrier by means of clamping and adjusting screws, respectively, found in the lower and upper end area of the glue roller as in DE-AS No. 11 11 562. The angular position as well as the working edge clearance can be regulated with respect to the glue roller periphery by means of the adjusting screws. It is is necessary to correct or alter the thickness of the glue film which happens quite often during normal labeling machine operation, then it is particularly important to rotate both of the two adjusting screws uniformly or the scraper blade edge may not be parallel to the surface of the roller in which case the gap between the scraper edge and the roller will vary in thickness over the length of the roller.

In still another known glue applicator device provision is made for coating two different kinds of labels, one for the necks and another for the bodies of bottles. The adjustment of the glue strip for the body label takes place in the usual manner by means of an adjusting screw that determines its angular position while the adjustment of the glue scrapers for the neck labels scrapers is accomplished by means of eccentric bushings and adjusting screws.

If the glue scraper on one of the known gluing devices becomes unoperational as a result of damage or wear to its working edge, the glue scraper must be exchanged in one piece and the basic setting for the newly installed scraper must be adjusted precisely. The blade exchange procedure is time consuming and the cost of spare parts which must be kept on hand is considerable.

SUMMARY OF THE INVENTION

A primary objective of the invention is to provide for making a rapid and cost effective exchange of a scraper blade having a worn working edge in a gluing device of the general type discussed above.

An important feature of the new gluing device is that the entire glue scraper assembly is no longer exchanged, but instead, only the blade insert that has the working edge is exchanged. The inserts have simple geometrical shapes and are relatively narrow so they contain little material and can be produced in a cost effective manner. By the special design of the stop surfaces, the proper angular position of the working edge relative to the support members for the insert blade is automatically established so that no readajustment of the support members relative to the support member carriers is necessary. Because of the ease of removing worn blades and installing new scraper blade inserts, the machine operators are more inclined to replace the blade inserts when they are only slightly grooved or hollowed. The resulting uniform thickness glue film promotes more accurate and stable location of the labels. With prior gluing devices discussed above, for example, the glue scraper blade was kept in operation as long as possible because of the inconvenience of making an exchange and because it was more costly to make the exchange when several parts had to be exchanged.

In some embodiments of the blade inserts described herein the inserts have several working edges so that by merely changing the position of the blade insert a new scraping edge can be presented toward the glue coated roller. No special tools are necessary to replace blade inserts. Typical multi-edges blades are angular or trihedral so as to provide several edges. Others are shaped like a prism since in all cases it is certain that, beside the working edges, parallel stopsurfaces are provided which are closely applied to surfaces of the support members and of the clamping members so the inserts are securely attached.

A more detailed description of several embodiments of the invention will now be set forth in reference to the drawings.

DESCRIPTION OF A PREFERRED EMBODIMENT

At the outset it should be understood that the drawings show only a roller to which a thick coating of glue would be applied cooperating with the scraper blade holders and scraper blades constituting the invention, In an actual labeling machine, the roller turns on a vertical axis and the nozzles apply a thick and relatively uneven coating of glue to the surface of the roller and a blade whose edge is almost in contact with the surface of the roller allows a gap between the edge and the roller which corresponds to the thickness of the glue film on the roller.

Figure 1:
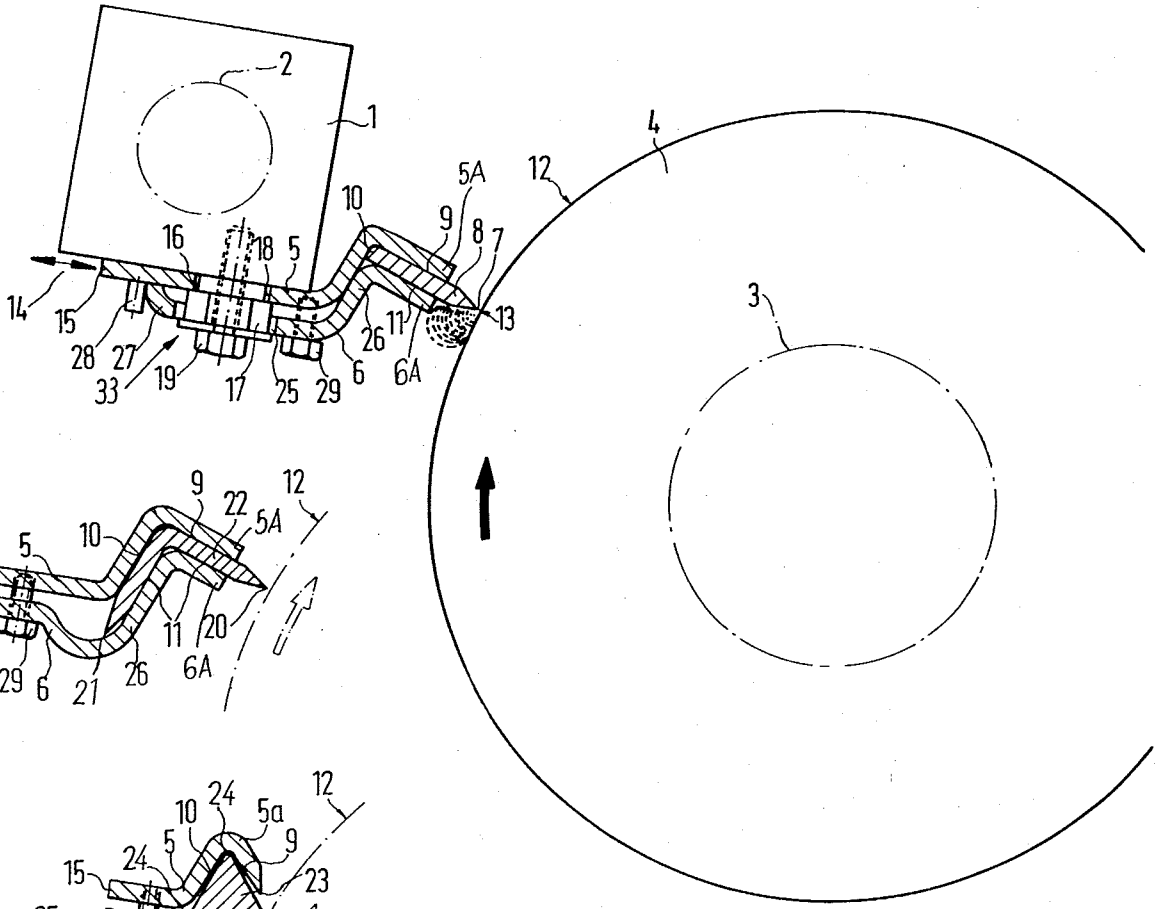
FIG. 1 is a transverse section, taken on the line 1—1 in FIG. 4, of one type of holder for a single edge scraper blade whose working edge is in close proximity to the periphery of glue roller that is rotatable about a vertical axis, said holder being mounted to a carrier bar.
Figure 4:
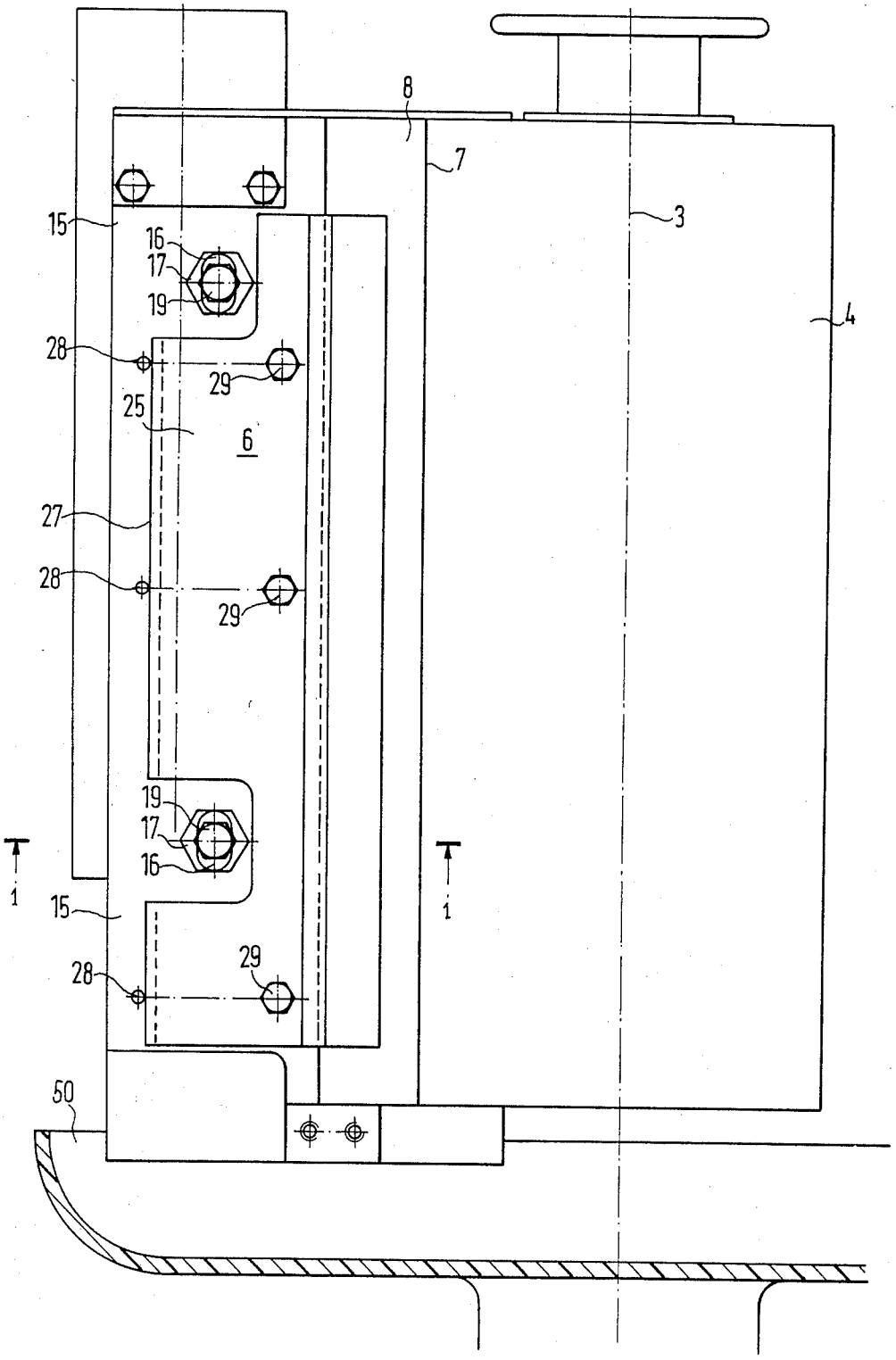
FIG. 4 is a side elevational view of the scraper blade holder and ink roller depicted in FIG. 1.

Referring to FIGS. 1 and 4, a glue roller is marked 4 and rotates about a shaft 3. A blade holder assembly is generally designated by the numeral 33. It is mounted to a carrier 1 that is turnable on a journal shaft 2. The axis of the shaft 2 is parallel to the rotational axis of the glue coated roller 4. A generally s-shaped support member 5 is mounted to carrier 1. A correspondingly shaped clamping member 6 is attached to support member 5. In FIG. 1, a glue scraper blade insert 8 is clamped between the free end 5A of the support member and the free end 6A of the clamping member. The support and clamping members are metal strips formed with nestable end portions having 45 degree angles. Blade 8 is adjustably held by support member 5 relative to the periphery of glue roller 4 such that the beveled edge 7 of the scraper blade nearly contacts the periphery of glue roller 4. The size of the gap between the edge 7 of insert blade 8 and the periphery of glue roller 4 corresponds to the thickness of the film on the glue roller resulting from the scraping action which occurs when the roller rotates. The ends 5A and 6A of the support member and clamping member, respectively, are substantially equal in length to the length of scraper blade insert 8 and the length of the scraper blade is almost equal to the length of the glue roller 4. The size of the gap between the edge 7 of blade 8 and the periphery 12 of glue roller 4 is established by slidably adjusting the straight portion 15 of support plate member 5 along the surface of carrier member 1 as indicated by the double headed arrow 14. There is an eccentric disk 18 in a hexagonal element 17. The disk, after establishing the clearance or gap between the scraping edge 7 of blade 8 and the periphery of roller 4, is secured by tightening a clamping bolt 19 which is threaded into carrier 1. The clamping member 6 and support plate 5 are compelled to move together by reason of a pin 28 being fixed in support member 5 and abutting against the curved edge of clamping member 6. The scraper blade 8 is held tightly between support member portion 5A and clamping member portion 6A by tightening a bolt 9 which passes with clearance through clamping member 6 and is threaded into support member 5. Because of the 90 degree bends in the support and clamping members 5 and 6, respectively, one edge 10 abuts against the face of the support member to assure that the blade insert 8 cannot change adjustment relative to the glue roller. When the edge 7 of blade 8 is worn or no longer straight, it is easily replaced by simply loosening bolt 29 and sliding the blade out from between the support and clamping members 5 and 6. After a new blade is inserted between the free ends 5A and 6A of the support and clamping members, the bolts 29 can be tightened again. The size and uniformity of the gap between the scraper edge 7 and glue roller periphery 12 can be checked with a feeler gage and an adjustment, if necessary, can be made by using bolt 19.

Figure 2:
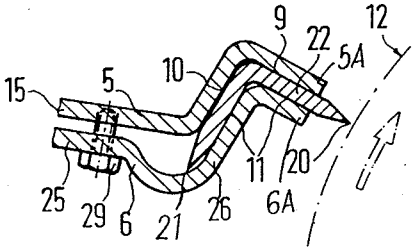
FIG. 2 is a transverse section of another embodiment of a blade holder and another form of blade insert which has two alternatively usable scraper edges.

An alternative embodiment of the easily exchanged glue scraper blade is depicted in FIG. 2 and identified generally by the numeral 22. The FIG. 2 and embodiments shown in FIGS. 3 and 5 parts having the same function as in FIG. 1 are given the same reference numerals. Blade insert 22 is L-shaped in cross section and has two beveled and sharpened scraper edges 20 and 21. In this case, it is not necessary to dispose or undertake reconditioning of scraper edge 20 when it is no longer accurate or worn, it is only necessary to reverse the blade insert 22 in the space between support member and clamping member parts 5A and 6A so that scraper edge 21 is located in the present position of edge 20. Adjustment of the gap between the scraper edge and periphery 12 of roller 4 is adjusted in the FIG. 2 embodiment as described in connection with the FIG. 1 embodiment.

Figure 3:
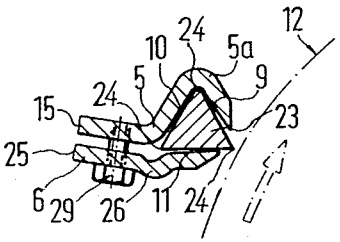
FIG. 3 shows part of a blade holder adapted for holding a trihedral blade insert having three alternatively usable scraper blade edges.

Another embodiment of the multi-edged scraper blade insert is generally designated by the numeral 23 in FIG. 3. In this embodiment, the blade insert 23 has the configuration of a polyhedron which is triangular in cross section so as to provide three alternatively usable scraper edges 24. In this case the outer ends of the support and clamping members 5 and 6 are appropriately configured for gripping insert 23 securely by tightening clamping bolt 29. As in the previous embodiment, the support member 5 is mounted to a carrier 1 and the same type of adjusting means is used in the FIG. 3 embodiment as is used in the FIG. 1 embodiment. The outer end of the support member 5 is bent at approximately an angle of 45 degrees, so that a channel like structure is formed from the insert 23.

The arrangements thus far described provide an elongated supporting member 5 and a clamping member 6 which cooperate to achieve a compact holding means for the blade inserts. Although as only shown in the FIG. 1 embodiment, there are a plurality of stopping pins 28 used in all embodiments. As a result of this a particularly rapid and simple installation and exchange of blade inserts can be accomplished since there are only a few bolts 29 to which a wrench must be applied to loosen them for permitting removal of a blade insert and for tightening the substitute or reversed blade insert again. The working edges 7, 20 and 24 of the various types of inserts all project with respect to the supporting element 5 in a direction toward glue roller 4. The blade inserts are composed of a heat resistant material such as metal or a wear-resistant plastic.

Figure 5:
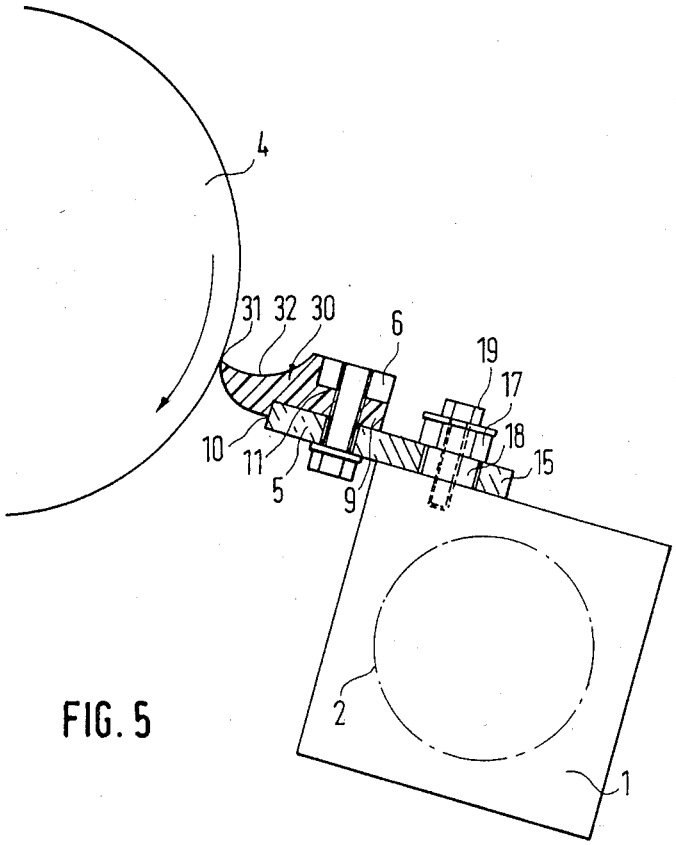
FIG. 5 is a transverse sectional view of an alternative form of blade holder and blade employing the blade insert exchange concept according to the invention.

Another implementation of the scraper blade insert concept is illustrated in FIG. 5. In this case, the insert 30 is composed of a rigid plastic material which is extruded and cut up into suitable lengths for being used as scrapers. The insert 30 is configured to form a channel 32 which extends over the length of the scraper edge 31 of the insert. The channel shape is intended to minimize the forces applied to the scraper edge 31 which results from the edge plowing through a rather viscous and relatively thick layer of glue that is deposited on the periphery 12 of roller 4 by means of nozzles, not shown. Additionally, the accumulation of glue ahead of the cutting edge 31 can flow down the channel into a glue recycling trough 50 as depicted in FIG. 4. Despite the channel-shaped cross section of scraper blade insert 30, it is manufactured rather inexpensively by means of extruding it. Parallel alignment of the working edge 31 of the blade insert of the FIG. 5 embodiment is achieved in the same manner as in the previous embodiments where the straight portion 15 of a support member 5 is clamped to a carrier 1 by a bolt 19 operating an eccentric 18.

FIG. 4 shows a side elevational view of a blade insert assembly in conjunction with a cooperating glue roller 4. This view is most appropriate to the FIG. 1 embodiment. Here one may see how the blade insert edge 7 approaches the periphery 12 of the glue roller 4. One may see how the clamping member 6 is substantially coextensive to the length of the blade insert 8. Because the blade edge 7 is scraping off the excess glue thickness, this excess glue flows downwardly along the surface of roller 4 and is collected in a trough 50 in a conventional manner so that the glue can be returned to the glue source for being recirculated through the nozzles, not shown which apply the glue to roller 4.

I claim:

1. A scraper device for regulating the thickness of a film of glue on a roller, said device comprising:

carrier means extending generally alongside of said roller and spaced from the periphery of said roller, a support member and mounting means for mounting said support member to said carrier means for said member to be adjustable toward or away from said roller, said support member having stop surfaces thereon, a glue scraper blade insert shaped for abutting said stop surfaces, said blade insert having at least one beveled scraper edge extending beyond said support member to provide a small gap between said edge and the periphery of said roller, and a clamping member having a stop surface and means for mounting said clamping member to said support member to press the support member against said blade insert so as to hold said blade insert against said stop surfaces on the support member to assure that said blade insert is held in the same position when inserts are exchanged.

2. The device according to claim 1 wherein a stop surface on said support member and a stop surface on said clamping member are parallel to accommodate between them a blade insert that has opposed parallel faces.

3. The device according to claim 1 wherein said blade insert is comprised of two elongated flat blades each having a beveled scraper edge, said blades being joined to form a unitary blade insert for being clamped between stop surfaces on said support and clamping members which are parallel.

4. The device according to claim 1 wherein said blade insert has a plurality of parallel scraper edges which can be positioned alternatively for scraping by altering the position of said insert with respect to said support member.

5. The device according to claim 4 wherein a transverse section of said insert exhibits the shape of a polyhedron.

6. The device according to claim 5 wherein said blade insert is shaped as a triangle.

7. The device according to any one of claims 1, 2, 3, 4, 5 or 6 wherein said means for mounting said clamping member to said support member to press said clamping member toward said support member are bolts passing with clearance through said clamping member and threaded into said support member adjacent the blade insert.

8. The device according to any one of claims 1, 2, 3, 4, 5 or 6 wherein said support member is a strip having a straight part interfaced with said carrier means and having a generally s-shaped part in continuity with said straight part to provide said stop surfaces for stopping said blade insert against moving relative to said members when said clamping member is mounted to said support member.

9. The device according to claim 1 wherein said support and clamping members are metal strips each having portions bent at corresponding angles of about 45 degrees in one direction and next at about 45 degrees in the opposite direction to form said stop surfaces on said support and clamping members in parallelism and form a channel for accommodating said blade insert.

10. The device according to claim 1 wherein said support member and clamping member are formed from metal strips or plates each of which has planar portions that are overlayed and each of which has a part angulated correspondingly away from the plane of said planar portion so that the angulated part of said clamping member extends into the angulated part of said support member, said angulated parts constituting said stop surfaces.

11. The device according to claim 10 wherein said supporting member has a slotted hole and said means for mounting said support member to said carrier means is a bolt threaded into said carrier means, an eccentric disk in said hole rotatable to adjust said support and clamping members, said disk being fixed by tightening said bolt.

12. A scraper device for regulating the thickness of a film of glue on a roller, said device comprising:

carrier means extending generally alongside of said roller and spaced from the periphery of said roller, a support member and mounting means for mounting said support member to said carrier means for said member to be adjustable toward or away from said roller, a clamping member for being superposed over said support member, said members having stop surfaces facing each other with a space between them when said clamping member is superposed, and means for mounting said clamping member to said support member, a glue scraper blade insert shaped in cross section for being inserted into said space to bear against said stop surfaces, said blade insert having at least one beveled scraper edge extending beyond said space to provide a small gap between said edge and the periphery of said roller, and means for pressing the stop surfaces on the clamping member against blade insert so as to press the insert against the stop surfaces on the support member to secure the blade inserts in a repeatable position when they are exchanged, said blade insert comprising a plastic extrusion having a beveled edge formed thereon for scraping glue from said roller, said blade insert having a channel formed adjacent said edge and coextensive in length therewith for conducting away excess glue that is scraped from said clamping member extends into the angulated part of said support member.

* * * * *

UNITED STATES PATENT AND TRADEMARK OFFICE

CERTIFICATE OF CORRECTION

PATENT NO. : 4,802,440

DATED : February 7, 1989

INVENTOR(S) : Hermann Kronseder

It is certified that error appears in the above—identified patent and that said Letters Patent is hereby corrected as shown below:

| | |
|---|---|
| Column 6, Line 45 | Delete "supporting" and substitute --- support --- |
| Column 8, Lines 5/6 | After "said" delete "clamping member extends into the angulated part of said support member" and substitute --- roller --- |

Signed and Sealed this

Twentieth Day of June, 1989

*Attest:*

DONALD J. QUIGG

*Attesting Officer*

*Commissioner of Patents and Trademarks*